US011788021B2

(12) United States Patent
Wegner

(10) Patent No.: US 11,788,021 B2
(45) Date of Patent: Oct. 17, 2023

(54) REACTOR AND PROCESS FOR GASIFYING AND/OR MELTING OF FEED MATERIALS

(71) Applicant: KBI INVEST & MANAGEMENT AG, Jonen (CH)

(72) Inventor: André Wegner, Coburg (DE)

(73) Assignee: KBI INVEST & MANAGEMENT AG, Jonen (CH)

( * ) Notice: Subject to any disclaimer, the term of this patent is extended or adjusted under 35 U.S.C. 154(b) by 0 days.

(21) Appl. No.: 17/296,956

(22) PCT Filed: Nov. 27, 2019

(86) PCT No.: PCT/EP2019/082807
§ 371 (c)(1),
(2) Date: May 25, 2021

(87) PCT Pub. No.: WO2020/109425
PCT Pub. Date: Jun. 4, 2020

(65) Prior Publication Data

US 2022/0025284 A1 Jan. 27, 2022

(30) Foreign Application Priority Data

Nov. 28, 2018 (EP) ..... 18208810
Nov. 28, 2018 (ZA) ..... 2018/08031

(51) Int. Cl.
*C10J 3/08* (2006.01)
*C10J 3/26* (2006.01)
(Continued)

(52) U.S. Cl.
CPC . *C10J 3/66* (2013.01); *C10J 3/08* (2013.01); *C10J 3/26* (2013.01); *C10J 3/72* (2013.01);
(Continued)

(58) Field of Classification Search
CPC ..... C10J 3/26; C10J 2300/0956; C10J 2200/152; C10J 2200/156; C10J 2200/09; C10J 3/20
See application file for complete search history.

(56) References Cited

U.S. PATENT DOCUMENTS 5,318,602 A * 6/1994 Juch ..... C10J 3/26 48/77
5,620,488 A * 4/1997 Hirayama ..... C10J 3/503 48/209
(Continued)

FOREIGN PATENT DOCUMENTS

DE 4030554 A1 4/1992
DE 19640497 A1 4/1998
(Continued)

*Primary Examiner* — Imran Akram
(74) *Attorney, Agent, or Firm* — Maschoff Brennan

(57) ABSTRACT

A reactor enables gasification or melting of waste and additional feed materials. The reactor includes a co-current section with a plenum section and a feed section with a sluice. Feed materials are introduced into the reactor. The reactor further includes a buffer section and a pre-treatment section, which adjoins a bottom of the buffer section to create a cross-sectional enlargement. An intermediate section adjoins the pre-treatment section. An upper oxidation section adjoins a bottom of the intermediate section and includes tuyeres in at least one level. An upper reduction section adjoins a bottom of the upper oxidation section. The reactor further includes a gas outlet section. The reactor further includes a countercurrent section having a conical lower reduction section and a conical lower oxidation section adjoining the conical lower reduction section having at least one tuyere and at least one tapping.

25 Claims, 5 Drawing Sheets

(51) Int. Cl.
*C10J 3/72* (2006.01)
*C10J 3/20* (2006.01)
*C10J 3/66* (2006.01)

(52) U.S. Cl.
CPC ..... *C10J 3/20* (2013.01); *C10J 2200/09* (2013.01); *C10J 2200/152* (2013.01); *C10J 2200/156* (2013.01); *C10J 2300/0906* (2013.01); *C10J 2300/0946* (2013.01); *C10J 2300/0956* (2013.01); *C10J 2300/1628* (2013.01); *C10J 2300/1687* (2013.01)

(56) References Cited

U.S. PATENT DOCUMENTS 6,112,677 A * 9/2000 Kuntschar ..... C10J 3/726 110/255
6,662,735 B2 12/2003 Tischer et al.
2002/0095866 A1* 7/2002 Hassett ..... C10J 3/72 422/150
2003/0010267 A1* 1/2003 Tischer ..... F23G 5/24 110/259
2010/0037519 A1* 2/2010 Patil ..... C10J 3/26 48/203
2010/0040510 A1* 2/2010 Randhava ..... C01B 3/382 422/232
2011/0078951 A1* 4/2011 Blasiak ..... C10B 49/06 202/99
2012/0171084 A1* 7/2012 Kuske ..... C10J 3/526 422/187
2014/0219874 A1* 8/2014 Potgieter ..... C10J 3/723 422/111
2014/0338262 A1* 11/2014 Schwarz ..... F23G 5/0276 48/89
2018/0105758 A1* 4/2018 Cheiky ..... C10J 3/42
2020/0332205 A1* 10/2020 Kelfkens ..... B01J 8/1809

FOREIGN PATENT DOCUMENTS

DE 19816864 A1 10/1999
EP 1 261 827 A1 12/2002
WO 0162873 A1 8/2001
WO 0246331 A1 6/2002

* cited by examiner

REACTOR AND PROCESS FOR GASIFYING AND/OR MELTING OF FEED MATERIALS

This invention relates to a reactor and a method for gasifying and/or melting of substances. In particular, the invention relates to the material and/or energy recovery of any waste, for example, but not exclusively household waste, used tires, hazardous waste, asbestos, hospital waste, coal or coal dust. The reactor and the method are also suitable for the gasifying and melting of feed materials of any composition or for the generation of energy through the use of waste and/or coal.

For some time now, solutions have been sought for the thermal disposal of various types of waste and other materials. In addition to combustion processes, various gasification processes are known, the main aim of which is to achieve results with a low pollutant load on the environment and to reduce the cost of treating the feed materials, but also the thermal and chemical application of the gases produced in the process. However, the known processes are characterized by a complex technology that is difficult to master and the associated high disposal costs for the feed material or waste to be treated.

EP 1 261 827 B1 discloses a reactor for the gasifying and/or melting of feed materials. This reactor does not follow the approach of the previously frequently used circulating gas process. In contrast, the disclosed reactor operates according to a combined co-current and countercurrent principle. The complete elimination of conventional recirculation gas management avoids many of the problems associated with the condensation of pyrolysis products and the formation of unwanted deposits. Furthermore, EP 1 261 827 B1 discloses that already in the upper part of the reactor a partial conglomeration of the feed materials takes place due to the shock-like heating of the bulk material (bulk column), whereby adherences to the inner wall of the reactor are largely excluded. In EP 1 261 827 B1 it is disclosed that a reduction section is formed between two injection means through which all gases flow before extraction, thereby reducing them to a large extent.

One problem to be solved by the present invention is therefore to provide an improved reactor and an improved method for gasifying and melting of feed materials.

This and other problems are solved by one or more aspects of the present disclosure.

As described herein, a reactor may include an upper co-current section, a central gas outlet section and a lower countercurrent section. In the co-current section, the gas flows downwards to the gas outlet section. In the countercurrent section, the gas flows from below to the gas outlet section. The gas escapes via at least one gas outlet in the gas outlet section.

The co-current section comprises a plenum section, an upper oxidation section and an upper reduction section. In the co-current section the gas flows parallel with the bulk. The bulk, which is the feed material fed into the reactor via a feed section, forms within the reactor a fixed bed, which moves continuously through the reactor in the direction of the reactor bottom.

The plenum section comprises a feed section with at least one sluice (e.g. a material lock, which may be a rotary lock, load-lock and/or an air-lock), a buffer section, a pre-treatment section and an intermediate section.

Via the feed section with a sluice, which is usually made of normal or creep-resistant steel, feed materials, e.g. waste materials, such as used tires, hazardous waste, asbestos waste, toxic hospital waste, industrial waste, electronic waste, coal and/or coal dust, non-recyclable plastic, wood or paper, light/coarse ASR (automotive shredder residues) and/or MSW (municipal solid waste) or the like, can be fed into the reactor from above. The sluice ensures that the uncontrolled entry of ambient air and the discharge of gases from the reactor are avoided as far as possible. It is intended that the sluices may have hydraulic, pneumatic or electrically operated hatches. These hatches can preferably be designed in such a way that the hatches are additionally closed in the event of unintentional overpressure in the reactor and no gas can escape unintentionally. In addition, pressure equalization lines may be provided to the atmosphere or other areas of the reactor. Due to this embodiment, the hatches can also be opened at the desired overpressure in the reactor, since the hatches drive does not have to work against a pressure difference.

The plenum section also includes a buffer section for buffering and pre-drying the feed material volume. The buffer section is also made of normal or creep-resistant steel. The temperature of the buffer section is preferably adjustable. For example, a set temperature of approx. 100° C. to 200° C. can be provided for the pre-drying of waste.

In addition, a pre-treatment section is provided in the plenum section, which is located below the bottom of the buffer section by creating a cross-sectional enlargement in the upper portion, the cross-sectional enlargement being preferably abrupt. Preferably, the cross-section area of the upper portion of the pre-treatment section increases at least twice compared to the cross-section area of the buffer section. Further, in the lower portion of the pre-treatment section the cross-section narrows. The pre-treatment section is preferably refractory lined. Further, the roof of the pre-treatment section may be refractory lined as well. The refractory can be of a thickness similar or different to that of other sections, to reduce heat loss caused by a high convection of the gas in this section. This roof refractory preferably covers the whole top surface of the pre-treatment section except in the area where the buffer section leads into the pre-treatment section. The roof refractory can be of a thickness similar or different to that of other sections. The cross-sectional enlargement in the upper portion of the pre-treatment section and the narrowing in the lower portion of the pre-treatment section is configured to create an internal collapsing cone area made of loosely packed bulk material within the gas space of the section. The collapsing cone area is supplied centrally with the feed materials from the buffer section configured to ensure optimized material flow in this area. Gas supply means (e.g. burners, nozzles, wall openings or other devices, enabling hot gases to be supplied to the bulk) are also provided above the collapsing cone area, in a so-called annular space, via which hot gases (e.g. combustion gases, temporarily stored or recirculated excess gases or inert combustion gases can be supplied. The surface of the collapsing cone area is thus shock-heated by the hot gases (to more than 800° C.), whereby sticking of the feed materials with the refractory lining (e.g. brick lining or castable lining) may be sufficiently avoided. Shock heating (with temperatures of e.g. 800° C.) of the surface can be achieved, for example, by means of burners directed radially at the bulk.

Alternatively or additionally, shock heating can also be achieved by means of a ring-shaped channel in which a flame rotates. This rotation can be achieved constructively by blowing the hot gas tangentially to the collapsing cone and burning it, preferably in the direction of the Coriolis force. The flame burns off any oxygen which flows from the buffer section and any gas which may flow back from the discharge area, thereby creating an overpressure and forcing the gas in the direction of the lower laying intermediate section and upper oxidation section. Thus the reactor requires no permanent $N_2$ blanketing, thus substantially reducing operating cost.

The plenum section also includes an intermediate section located below and adjacent to the pre-treatment section. In the intermediate section, the heat from the pre-treatment section and the waste heat from the upper oxidation section located below the intermediate section are used for final drying, pyrolysis of the feed materials and preheating for the subsequent upper oxidation section. The typical combustion/pyrolysis temperatures of the intermediate section lead to the formation of complex molecules, e.g. liquid tars/oils or organic gases/vapors. The intermediate section may be designed such that the top of the reactor is shielded from the heat from the subsequent upper oxidation section, which may be more than 2000° C. Compared to reactors of the cupola-type, this section is considerably less high because the shielding function is ensured by the feed and buffer sections' design and construction materials. The reactor may therefore be on the whole smaller or has a higher throughput at the same height compared to a cupola-type reactor. It may be advantageously provided that the intermediate section is refractory lined (e.g. brick lined or castable lined) within the steel shell, wherein the refractory can be of a thickness similar or different to that of other sections. This embodiment simplifies the commissioning (starting up) of the reactor, as high temperatures can also occur in the intermediate section during this time. The intermediate section can either be cylindrical or extend downwards in cross-section. The cylindrical structure is advantageous for the manufacture of the reactor, since a cylindrical intermediate section is easier to produce. However, it can also be advantageous if the cross-section of the intermediate section widens downwards, as e.g. the use of coal can cause the bulk volume to expand due to the heat rising from below. However, if the cross section is widened, it may be possible to prevent the coal from jamming.

Below the intermediate section in the co-current section there is an upper oxidation section in which tuyeres are arranged. The tuyeres are arranged in at least two levels, at least one upper level (defined by the height or vertical distance from the reactor bottom), and one lower level (defined by the height or vertical distance from the reactor bottom, which is smaller than the vertical distance from the reactor bottom of the upper level). At least one tuyere is arranged per level. It may be advantageous that at least two or more tuyeres are arranged per level, whereby these tuyeres may further be arranged all-round, preferably radially distributed, on each level. Since the tuyeres are arranged on at least two levels, it is achieved that the oxidation section is considerably larger than with reactors, which have only one level with tuyeres. Due to the enlarged upper oxidation section, the throughput at the same diameter as well as the residence time of the feed materials can be increased compared to reactors which have only one level with tuyeres and a safe destruction of all organic compounds can be achieved. Further, due to the arrangement of the tuyeres in at least two levels is advantageous because a better distribution of the gas may be achieved with uniform heating of the bulk. In addition, this may ensure that local overheating of the refractory lining (e.g. brick lining or castable lining) is avoided as far as possible.

Through the tuyeres untreated or preheated oxygen and/or air can be supplied to the bulk, which has moved into the upper oxidation section.

It can be provided that the tuyeres (of the upper oxidation section and the conical lower oxidation section) are made of copper or steel. Furthermore, it may be provided that the tuyeres have a ceramic inner tube, This embodiment of the tuyeres (with a ceramic inner tube) enables the tuyere to be protected against melting of the metal by adding oxygen and/or air, whereby oxygen and/or air that can also be preheated (e.g. to temperatures >500° C.). It can also be advantageous that a compressible and temperature-resistant layer is arranged between the ceramic inner tube of the tuyere and the metal tuyere itself, whereby thermally induced mechanical stresses can be compensated. This compressible and temperature-resistant layer consists, for example, of high-temperature felt, high-temperature cardboard or high-temperature foam.

Alternatively, the tuyeres may be made of ceramic. Through this embodiment it can be achieved, for example, that the oxidation section can be operated with a supply of hot air and/or oxygen having a temperature more than 1000° C. and thus a bulk temperature of more than 2000° C., since ceramics can withstand higher temperatures than metals, which are usually water-cooled.

The inevitably necessary cooling of metallic tuyeres is not necessary for tuyeres made entirely of ceramics, whereby the heat loss can be reduced by more than 5%. The chemical load caused by melting without cooling and the high thermal stress can be achieved for these tuyeres by a combination of ceramics with good thermal conductivity (e.g. silicon carbide with e.g. 85 W/(m·K)) and slag freezing, followed by insulating ceramics (e.g. Spinel Corundum with less than 4 W/(m·K)).

As described above, the tuyeres made of metal or ceramic are arranged on at least two levels. By adding oxygen and/or air, whereby oxygen and/or air can be untreated or preheated, the temperature in the oxidation section is increased to such an extent that all substances are converted into inorganic gas, such as carbon monoxide (CO), hydrogen ($H_2$), water ($H_2O$), carbon dioxide ($CO_2$), hydrogen sulphide ($H_2S$), ammonia ($NH_3$), nitrogen dioxide ($NO_2$) or sulphur dioxide ($SO_2$), liquid metal or liquid slag, coke or carbon (C). The temperature can be, for example, about 1500° C. to 1800° C. at the edge area of the upper oxidation section, and may 200 be above 2000° C. to 3000° C. in the center of the bulk.

It may be advantageously provided that the upper oxidation section comprises a refractory lining (e.g. brick lining or castable lining) within the steel shell, wherein the refractory can be of a thickness similar or different to that of other sections.

The upper oxidation section can either be cylindrical or tapered towards the bottom. The cylindrical structure is advantageous for the manufacture of the reactor as a cylindrical upper oxidation section is easier to produce. It can also be advantageous, however, if the cross-section is wider than the cylindrical design in the top section of the upper oxidation section and narrows downwards, to follow the reduction of the bulk volume turning into gas, having a smaller diameter at the bottom of the upper oxidation section. This design allows that the oxygen may better reach the middle of the bulk, thereby avoiding zones of partially untreated material in the center ("dead man"). Due to the possible larger diameter at the top of the upper oxidation section, a capacity increase of over 30% per meter height of the upper oxidation section is feasible.

Below the upper oxidation section, an upper reduction section is arranged in the co-current section, into which essentially no organic components enter. It can be advantageously provided that the upper reduction section has a cross-sectional enlargement compared to the upper oxidation section, which changes the sinking rate of the then essentially completely carbonized bulk and increases the residence time (compared to a reactor of the same height). It may be advantageously provided that the upper reduction section comprises a refractory lining (e.g. brick lining or castable lining) within the steel shell, wherein the refractory can be of a thickness similar or different to that of other sections. The upper reduction section is designed such that the heat/thermal energy produced in the oxidation section is turned into chemical energy (e.g. by endothermic Boudouard and watergas reactions). In the upper reduction section, the gas flows through the carbonized bulk in co-current and thermal energy is converted into chemical energy. In particular, carbon dioxide ($CO_2$) is converted into carbon monoxide (CO) and water ($H_2O$) into hydrogen ($H_2$) and carbon monoxide (CO), whereby the carbon still contained in the bulk is further gasified. As they pass through the upper reduction section, the gases are simultaneously cooled (by the endothermic reaction), for example to temperatures between approx. 800° C. (e.g. complete conversion to $H_2$) and approx. 1500° C., wherein at a temperature of above 1000° C. a complete conversion to CO takes place. As all material flows are forced through the upper oxidation section and cannot be returned, there is no longer any contact of both carbonated bulk as well as the gas with the unreacted materials from above the upper oxidation section (the plenum section). In this way, all cleanly cracked and/or melted, exclusively inorganic substances reach the gas outlet section without anew contamination.

By the free choice of height and diameter of the upper reduction section, different residence times can be realized. The longer the residence time at sufficient heat, the more $H_2$ and CO can be formed. Furthermore, the upper reduction section can be designed in such a way that cooling can take place in such a way that standard refractory lining materials, such as e.g. Alumina-, Spinel- or Chrome-corundum, can be used.

As the gas leaving the upper reduction section in co-current and also the gas leaving the below arranged countercurrent section in countercurrent, the gas would have a high gas velocity and thus entrain a lot of dust, rendering economic gas cleaning unlikely. Hence, it is within the scope of the invention that the cross-sectional area of the gas outlet section is larger than the cross-sectional area of the upper reduction section. Hence, a cone-shaped bulk can form. Due to the greatly increased surface area of the cone-shaped bulk, the gas flows off at a significantly reduced speed (e.g. at 0.5 m/s) and the dust entrainment is reduced to such an extent that standard dust separators (e.g. cyclone, bag filter) can economically separate the remaining dust. It is provided that the gas outlet section comprises at least one gas outlet. This at least one gas outlet may be arranged in the gas outlet section in such a way that the gas can either escape at an upward angle or that the gas is discharged downwards. It is also conceivable that several (e.g. four) gas outlets are arranged all-round, preferably distributed evenly around the circumference. In addition to the gas coming from upper reduction section, the gas coming from the bottom (from the lower conical reduction section and the lower conical oxidation section) also flows through the gas outlet section. At the latest, the last reaction (water gas shift reaction, $H_2+CO_2 \rightarrow H_2O+CO$) takes place in the gas chamber above the cone-shaped bulk, in order to then leave the reactor.

The gas outlet section is preferably refractory lined within the surrounding steel shell. The refractory can be of a thickness similar or different to that of other sections. It may be also preferable that a refractory is arranged at the top of the gas outlet section. This top refractory preferably covers the whole top surface of the gas outlet section except in the area where the upper reduction section leads into the gas outlet section. The top refractory can be of a thickness similar or different to that of other sections.

Below the gas outlet section there is an essentially conical countercurrent section. In the countercurrent section, the gas flows from below to the gas outlet section, thus in the opposite direction of the bulk still moving downwards (in the direction of the reactor bottom). The conical countercurrent section is preferably refractory lined within a surrounding steel shell.

The conical countercurrent section comprises a conical lower reduction section to convert the thermal energy of the gas from the conical lower oxidation section into chemical energy (mainly CO) and to generate the gas flow upwards in countercurrent to the bulk moving downwards. This conical lower reduction section, for which the cut-off tip of the cone of the conical lower reduction section points downwards, is located below the gas outlet section.

In the conical lower reduction section and in the gas outlet section, during reactor operation, the bulk of residual carbonized material (which has not yet been converted into gas), slag and metals can also be arranged in the form of a double truncated cone.

Here the upper truncated cone, the outer surface of which corresponds substantially to the gas outlet surface, projects into the gas outlet section and the lower truncated cone is arranged in the conical lower reduction section and the conical lower oxidation section.

Below the conical lower reduction section a conical lower oxidation section is arranged with the cut tip of the cone pointing downwards. In the conical lower oxidation section the residual carbonized material is converted into gas. For this, in the conical lower oxidation section at least one tuyere, consisting of metal or ceramic, as previously described for the upper oxidation section, is arranged in at least one level, via which untreated or preheated oxygen and/or air can be supplied to the molten metal and slag. By the introduction of untreated or preheated oxygen and/or air, temperatures comparable to the upper oxidation section are generated and the remaining solids (mostly carbon, plus metal and slag) can thus be oxidized and turned into gas. The resulting gas then flows in the direction of the gas outlet section via the conical lower reduction section, this time in countercurrent to the bulk moving downwards towards the reactor bottom. Since all material was previously forced through the upper oxidation section, all materials in the lower conical oxidation section are inorganic (hence no Seveso toxins, tars, oils, organic components, plastics, and so on). The gas flowing to the gas outlet section is therefore not contaminated by this countercurrent gas. Further, the temperature can be adjusted (e.g. to temperatures >500° C.) in such a way that the molten slag and the molten metals can emerge in liquid form via at least one tapping, for collection and discharge. Metal and slag, for example, can be collected in coquille moulds. It can also be provided that a continuous granulation (liquid or dry) with subsequent separation of metal and slag is carried out via e.g. a magnetic separator. Furthermore, it is conceivable that two separate tappings (as for a furnace) are provided so that metal and slag can drain off separately.

Since $CO_2$ and $H_2O$ are also produced in the conical lower oxidation section, the excessive thermal energy in the lower conical reduction section (as previously described for the upper reduction zone) is converted into usable chemical energy. $CO_2$ is converted to CO on the hot carbonized material (C), $H_2O$ to $H_2$ and CO. Here, the gas can also cool to over 1000° C. (complete conversion to CO) and to about 800° C. (complete conversion to $H_2$).

Since according to the invention the reactor has both a lower reduction section in the countercurrent section and an upper reduction section in the co-current section, the total reduction section volume (sum of the volumes of the upper and conical 335 lower reduction sections) can be considerably larger than the one reduction section of known reactors. As an example, reference is made to EP 1 261 827 B1, in which only one reduction section is arranged in the area of the gas outlet section. The increased volume for the lower conical reduction section is achieved by the cone design of the countercurrent section (whereby the cone has an angle of approx. 60° from a hypothetical horizontal axis. For all subsequent angles it is intended that an angle of 0° corresponds to a hypothetical horizontal and an angle of 90° corresponds to a right angle (starting from a hypothetical horizontal). The cone design also ensures that the slag can drain off without freezing and/or excessive wear on the refractory.

Since according to the invention the reactor has two reduction sections, namely an upper reduction section in the co-current section and a conical lower reduction section in the countercurrent section, considerably more thermal energy can be converted into chemical energy, in the form of more $H_2$ or CO. A further advantage may be that the arrangement of the upper reduction section in the co-current section means that considerably lower temperatures can be achieved in the gas outlet. Alternatively, it may be achieved by this embodiment that the upper oxidation section can be operated at higher temperatures, e.g. with a temperature at the edge of the oxidation section of more than 1800° C., but the gas outlet temperature is still comparable to the gas outlet temperatures of known reactors, e.g. about 800° C. to 1000° C. Furthermore, it may be conceivable that the upper oxidation section can be operated at higher temperatures, e.g. at a temperature for which the bulk material has on its outer surface (where it is in touch with the refractory of the oxidation section) of more than 1800° C., whereby the gas outlet temperature can be up to 1500° C. or above.

Thus according to the invention, the reactor achieves a simple, inexpensive and environmentally friendly material and/or energetic utilization of feed materials. In addition, a capacity increase is made possible by employing the reactor described 365 herein.

For one embodiment of the reactor, it is intended that the upper reduction section is arranged above the gas outlet section, wherein the gas outlet section adjoins the lower part of the upper reduction section by creating a cross-sectional enlargement. Here it could be conceived, that the cross-sectional enlargement is abrupt/discrete.

Preferably, the cross-sectional area of the gas outlet section increases by at least twice that of the cross-sectional area of the upper reduction section.

This embodiment ensures that the bulk widens conically, thereby increasing the surface area or discharge area of the bulk. The surface or discharge area of the bulk essentially corresponds to the outer surface for a truncated cone-shaped design.

An embodiment provides that the cross-sectional enlargement is such that the discharge area of the bulk is at least three times larger than the cross-sectional area of the upper reduction section. Furthermore, the cross-sectional enlargement can be so large that the discharge area of the bulk is at least seven times or even at least nine times larger than the cross-sectional area of the upper reduction section.

For this or a further embodiment, it may also be provided that the cross-sectional enlargement of the gas outlet section is such that the discharge area of the bulk is increased by at least five times the cross-sectional area of the upper oxidation section. Furthermore, the cross-sectional enlargement can be so large that the discharge area of the bulk is at least nine times larger than the cross-sectional area of the upper oxidation section.

The advantage of the above-mentioned embodiments is that the gas flow velocity (leaving the surface of the cone-shaped bulk) is reduced proportionally to the increased discharge area of the bulk (compared to known reactors), so that the dust entrainment from the bulk can be minimized.

A reduced dust entrainment is particularly advantageous in order to be able to carry out a subsequent gas cleaning or dust separation economically. Furthermore, this embodiment enables the dust (due to the small quantities) to be returned to the gasifier inlet without significantly reducing the capacity of the reactor for fresh feed material, eliminating the need to dispose hazardous dust waste.

Alternatively, it may be provided for the reactor that at least a portion of the upper reduction section is arranged or inserted into the gas outlet section. This embodiment may also provide for the gas outlet section to have a larger cross-section than the upper reduction section.

With this embodiment, the co-current section with a part of the upper reduction section is partially) inserted into the gas outlet section. For example, the refractory lining (e.g. brick lining or castable lining) of the upper reduction section may protrude into the gas outlet section. Since the gas outlet section has a larger cross-sectional area than the upper reduction section and the at least one gas outlet is located in the edge portion of the gas outlet section, the gas produced in the co-current section must bypass the refractory lining (e.g. brick lining or castable lining) extending out into the gas outlet section in order to reach the gas outlet, whereby less dust enters the dust separation. This embodiment allows the overall height of the reactor to be reduced. Furthermore, the dust separation can be improved by this embodiment, since the gas and the entrained dust must additionally flow upwards in order to reach at least one gas outlet, thus being subject to gravitational separation.

It may also be provided that the refractory lining (e.g. brick lining or castable lining) of the upper reduction section extending into the gas outlet section is formed as a hollow cylindrical shape. The hollow cylindrical shape may be made of steel, which has an ability to withstand high thermal and consequently mechanical stresses. For example, the hollow cylindrical shape can be protected by water cooling and/or being lined on both sides.

For a further embodiment of the invention, it is provided that the volume ratio of the upper oxidation section volume to the plenum section volume is a ratio of 1:N volume units, wherein N is a number greater than or equal to (≥)4 and less than or equal to (≤)20. Hereby, the volume of the upper oxidation section is defined as the inner volume between the upper edge of the at least one tuyere of the upper level, the lower edge of the at least one tuyere of the lower level and the circumferential refractory lining. Further, the volume of the plenum section is defined as the inner volume between the sluice, the upper edge of the at least one tuyere of the upper level of the upper oxidation section and the circumferential lining.

Table 1 shows three exemplary inventive reactors (Example 1, Example 2 and Example 3) as well as a cupola-type reactor as shown in EP 1 261 827 B1 with its internal section volumes. Example 1 is an inventive size 55 reactor (a reactor, which has an inner diameter of 55 inches in the upper oxidation section) for which the upper reduction section is partially located in the gas outlet section, example 2 is an inventive size 110 reactor (a reactor, which has an inner diameter of 110 inches in the upper oxidation section) where the upper reduction section is located above the gas outlet section and example 3 is an inventive size 110 reactor where the central vertical longitudinal axis of the co-current section is arranged horizontally offset with respect to the central vertical longitudinal axis of the gas outlet section and the gas countercurrent section.

TABLE 1

Internal volumes of the sections of three inventive reactors (examples 1 to 3) and one known reactor (cupola-type reactor).

| | Reactor Example 1 [$m^3$] | Reactor Example 2 [$m^3$] | Reactor Example 3 [$m^3$] | Cupola-type reactor [$m^3$] |
|---|---|---|---|---|
| Feed section | 2.7 | 3.2 | 3.2 | 0.3 |
| Buffer section | 4.0 | 6.0 | 6.0 | 0.4 |
| Pre-treatment section | 4.7 | 41.6 | 41.6 | 3.7 |
| Intermediate section | 4.0 | 20.4 | 20.4 | 3.5 |
| Upper oxidation section | 1.4 | 9.9 | 9.9 | 0.2 |
| Upper reduction section | 3.1 | 38.7 | 38.7 | 0.7 |
| Gas outlet section | 3.3 | 32.2 | 56.3 | 1.0 |
| Countercurrent section | 7.3 | 59.5 | 29.1 | 1.3 |
| SUM | 30.5 | 211.5 | 205.2 | 11.1 |

Since the volume of the plenum section is the sum of the internal volumes of the feed section, the buffer section, the pre-treatment section and the intermediate section, it is evident from Table 1 that for the inventive reactors the N is smaller than 20 (here for Example 1 N is about 11.2; for Examples 2 and 3 N is about 7.2), whereas for the state of the art reactor N is in about 37.

Thus, it is shown that the upper oxidation section volume of the inventive reactor may be many times larger compared to previously known reactors, whereby a higher capacity can be achieved in relation to the diameter that is limited to a given maximum. In addition, the longer path of gases through that section will more thoroughly destroy unwanted side-products (e.g. phenoles) that cannot appear at the gas exit, thereby avoiding difficult gas cleaning issues and/or toxic emissions. Here it is further conceivable that $5 \leq N \leq 15$ or even $6 \leq N \leq 12$.

A further embodiment provides that the volume ratio of the upper oxidation section volume to the total volume of the upper reduction section volume and the plenum section volume is a ratio of 1:N volume units, wherein N is a number greater than or equal to (≥)7 and less than or equal to (≤)20. Here it is further conceivable that $7 \leq N \leq 15$. Hereby the volume of the total volume of the upper reduction section volume and the plenum section volume is the inner volume between the sluice, the lower edge of the at least one tuyere of the lower level of the upper oxidation section and the circumferential lining.

Since the total volume of the upper reduction section volume and the plenum section volume is the sum of the internal volumes of the feed section, the buffer section, the pre-treatment section, the intermediate section and the upper reduction section, it is evident from Table 1 that for the inventive reactors the N is smaller than 20 (for Example 1 N is about 13.4; for Examples 2 and 3 N is about 11.2), whereas for the state of the art reactor N is about 36.

This embodiment of the reactor is advantageous because the retention time of the gas in the inventive reactor is many times larger than compared to previously known 485 reactors, allowing the kinetic-driven heterogeneous reaction to complete better, thus reducing more $CO_2$ and $H_2O$ in favor of the valuable $H_2$ and CO. It also promotes the reaction of the aggregate CaO with the byproduct HCl to $CaCl_2$, thus simplifying the gas cleaning, e.g. no condensate corrosion or formation of the tricky $NH_4Cl$.

A further embodiment of the reactor provides that the volume ratio of the countercurrent section volume to the total volume of the reactor is a ratio of 1:N volume units, where N is a number between 1 and 8 ($1 \leq N \leq 8$?).

Here it is further conceivable that $2 \leq N \leq 7.5$ or even $2.5 \leq N \leq 7.5$. Hereby the volume of the countercurrent section is the inner volume between the projected level in the height, where the cone-shaped bulk connects with the refractory lining (of the conical lower reduction section), the refractory lining of the conical lower reduction section and the conical lower oxidation section and the bottom of the reactor. The volume of the lower oxidation section is the inner volume between the upper edge of the at least one tuyere of the lower level, the refractory lining of the conical lower oxidation section and the bottom of the reactor.

Due to the cross-sectional enlargement of the gas outlet section and the countercurrent section, the cone shaped bulk area in the conical lower reduction section is also enlarged, configured to ensure lower gas flow velocities out of the bulk material and consequently less dust is entrained in the exit gas.

Another advantageous embodiment of the reactor is that the angle of the conical lower reduction section and the angle of the conical lower oxidation section are between 50° and 70°. Due to this embodiment, the slag, which is kept liquid at sufficiently high temperatures in the conical lower oxidation section and the conical lower reduction section, drains off better, since the walls run at an angle of approx. 50-70°, preferably approx. 60°. Due to this design, the wear of the refractory and thus the maintenance may be reduced further, therefore allowing a longer uptime.

A further embodiment of the reactor provides that the pre-treatment section, the intermediate section, the upper oxidation section, the upper reduction section, the gas outlet section, the conical lower reduction section and the conical lower oxidation zone each comprise a refractory lining, each section may vary from the others, wherein each refractory lining of each section comprises between two and six layers. Each layer of each section may be further made of a different material. Thus, for example the upper oxidation section may have a completely different lining than e.g. the pre-treatment section, in regards of total thickness, thickness of each layer, material of each layer and application of the lining. The material of each layer may be selected from the group comprising bricks, castable/gunnable refractories, cements, stone wools, ceramic wools, glass wools, felts, fibre boards, paper boards, plastic sheets and laquer-woodchip-mixtures. Further, depending on the layer and section the refractory support system may be selected from the group comprising creep resistant steel anchors, ceramic anchors, self-carrying brick assemblies and water-cooled pipes (with or without fins). The base criteria to be fulfilled by the layer may comprise chemical resistance, thermal resistance, physical stability (cold crushing strength), insulation, minimized wear (lifetime), general safety and constructability. Depending on the governing criteria per section, materials, layer thicknesses, and number of layers may vary for each section. The first layer is the innermost layer, being in contact with the reaction zones.

Due to the low temperatures in the plenum section with feed section and buffer section no chemical or thermal stability is required. Hence, creep-resistant steel without refractory may thus be sufficient. Further, as the roof of the pre-treatment section does not need any mechanical stability, as the roof only carries its own weight only an insulating layer may be necessary to the keep heat loss down. The refractory of the sides in the pre-treatment section however may need some further mechanical stability against the weight of the refractory above. In addition, the refractory may be exposed to a potential chemical attack from the bulk. Therefore, the refractory may have up to five layers, which exemplary may be made from castable Alumina Corundum or Spinel Corundum.

As in the intermediate section the temperature drops sharply due to the vaporization, pyrolysis, desoxidation, desulfurizing, depolimerization, $H_2S$ separation, carbonization, cracking and tar/heavy oil formation, the refractory may have up to four layers, made e.g. from castable Spinel or Chrome Corundum.

It can be advantageous for a waste-to-energy application of the reactor that the refractory lining of the upper oxidation section comprises wear-resistant bricks made from Chrome Corundum, Spinel Corundum or ceramics from Carbides or Nitrates-as it is the most critical section in regards to temperature, chemical and wear resistance. For the first layer, bricks may be preferred, e.g. made from Spinel or Chrome Corundum. It may be further envisaged the thickness of the total refractory may be up to 1000 mm or even more than 1000 mm. Alternatively, it can be advantageous for a reactor that the refractory lining of the upper oxidation section has a thickness not exceeding 500 mm. In this embodiment it is envisioned that the refractory lining is strongly cooled, whereby a slag freezing is formed on the inside of the refractory lining, protecting the refractory lining. This embodiment may be necessary for reactor feeds with a heating value of >24MJ/kg. As more chemical energy and more thermal energy are produced with this reactor feeds, higher temperature in the upper oxidation section and richer gas on the outlet section may be obtained. This embodiment may thus be especially favorable for waste to fuel and/or energy to fuel applications (e.g. conversion into hydrogen, methanol, methane or Fischer-Tropsch-fuels (XtL; X-to-Liquid)).

As in the upper reduction section the temperature drops substantially compared to the upper oxidation section, the dimensions of the refractory may be as described for the upper oxidation section, however, as the upper reduction section has a large surface for the heat loss, it is envisioned that the refractory comprises thinner resistant refractory layers and thicker insulating refractory layers, thus reducing heat loss and thus improving the thermal efficiency of the reactor and as a result the thermal efficiency of the whole waste-to-X plant, wherein X may be energy, fuel, water or recycled metal.

The refractory of the roof of the gas outlet section is preferably build in the same way as the roof of the pre-treatment section, however may have one more layer with high physical stability, as e.g. castable Alumina Corundum, Spinell Corundum or Andalusite cement, as this roof also supports part of the refractory of the upper sections. The refractory of the sides of the gas outlet section is built as the below arranged lower reduction section, for which the requirements are preferably the same as for the upper reduction section. The refractory of the lower conical oxidation section with the hearth/tapping comprises the same layers as the upper oxidation section. However, as in this section the highest chemical attack (slag and molten metal reservoir) occur and as the complete weight of the above reactor is resting on this section, the wall thickness is preferably up to two meters. Further the wall thickness of the refractory may be even more in the area of the tapholes.

As previously described, it may be further advantageous that the inner cross-sectional area of the intermediate section is cylindrically constant or is tapered (widens) in the direction of the reactor floor, the inner cross-sectional area of the upper oxidation section is cylindrically constant or is tapered (narrows) in the direction of the reactor floor, and the inner cross-sectional area of the upper reduction section is cylindrical constant or widens towards the bottom of the reactor immediately following the upper oxidation section. As described above, the cylindrical constant cross-sectional area is easier to produce.

However, a widening of the intermediate section prevents the material jamming in the intermediate section, e.g. bulky materials like low quality coal waste, due to thermal expansion when the bulk moves down towards the upper oxidation section.

A narrowing of the upper oxidation zone allows the inner surface to follow the reduction of the bulk while the volume turns into gas, having a smaller diameter at the bottom of the oxidation zone and thus allow the oxygen to better reach the middle of the bulk, avoiding zones of partially untreated material in the center ("dead man"). Due to the now possible larger diameter at the top of the oxidation zone, this allows a capacity increase of over 30% per meter height of the oxidation section.

As described above for the intermediate section and the upper oxidation section, a cross-sectional enlargement or narrowing may be also advantageous, as to smoothly expand from the diameter of the upper oxidation section to the diameter of the upper reduction section. This way, the cross-section can be enlarged which results in the high retention time and better $CO/H_2$ content, but without risking the formation of a gas pocket, not allowing incompletely reacted gas components to reach the gas outlet via a short circuit.

Further, it may be easier for the construction if both, the inner cross-sectional area of the intermediate section and the inner cross-sectional area of the upper oxidation section are cylindrically constant. For the process it may however be advantageous, if the inner cross-sectional area of the intermediate section widens in the direction of the reactor floor, thereby increasing the cross-sectional area for reasons described above and the subsequent inner cross-sectional area of the upper oxidation section narrows in the direction of the reactor floor, thereby increasing the cross-sectional area for reasons described above.

Another advantageous embodiment of the reactor is that at least one further tuyere is arranged on a level of the conical lower reduction section.

The further tuyere additionally supplies air and/or oxygen in such a defined way, so that almost no $CO_2$ is produced, but almost exclusively CO. Furthermore, it can be achieved through this embodiment that the throughput can be increased.

Furthermore, it can be achieved that the gas outlet temperature at the gas outlet can be increased to temperatures of up to 1500° C. without impairing the quality of the gas.

For applications that prefer thermal energy over chemical energy, it may be further advantageous that at least one additional tuyere is arranged in the upper reduction section. Through this embodiment it can be advantageously achieved that excessive chemical energy (CO, $H_2$) is turned back to thermal energy by oxidizing excessive CO to $CO_2$ and $H_2$ to $H_2O$.

A further embodiment provides that at least one other tuyere is arranged on a further level (height) of the conical lower oxidation section. This tuyere is located preferably above the tapping.

By arranging the tuyere above the tapping, a more efficient melting can be facilitated in the area of the tapping, as the heat is generated in the area where the melt is to run off liquid. At the same time, the arrangement of the tuyere above the tapping ensures that the solidified melt desired on the opposite side of the tapping (so-called slag freezing, which protects the refractory lining, e.g. brick lining) is not liquefied and therefore does not flow off.

In order to achieve a further increase in capacity, the invention provides that the internal cross-sectional area of the upper oxidation section is designed in such a way that the maximum distance from any point within the bulk formed from feed materials to an outlet of at least one of the tuyeres is less than a predetermined minimum distance. The minimum distance is

- less than 1.3 m at gas temperatures below 100° C. and at gas velocities below 100 m/s
- less than 1.9 m at gas temperatures below 100° C. and at gas velocities between 100 m/s and 343 m/s (sound velocity) and
- less than 3.2 m at gas temperatures above 100° C. and/or at gas velocities >343 m/s wherein the temperature and the gas velocities (gas flow divided by $PI/4\times ID^2$) are provided at the outlet of the tuyeres.

Through this embodiment and through suitable tuyeres, which can be designed as high-speed or even supersonic nozzles, an increase in diameter of the reactor and thus an increase in capacity can be achieved, since also the center of the bulk can be easily reached by the oxygen and/or air introduced via the tuyeres. As described above, the supplied oxygen and/or the supplied air may be preheated, for example to a temperature greater than or equal to 100° C. or even between 500° C. and 1000° C.

According to one embodiment of the invention, areas of the pre-treatment section, the intermediate section, the upper oxidation section and the upper reduction section may have a cross-sectional area of the same kind, for example a circular cross-sectional area.

It is also conceivable that the inner cross-sectional area of the oxidation section is formed as a circular ring or an elliptical ring.

A further increase in capacity may be achieved by designing the internal cross-sectional area of the upper oxidation section as a non-circular internal cross-sectional area. Likewise, regions of the pre-treatment section, the intermediate section and the upper reduction section may have a, preferably uniform, substantially non-circular cross-sectional area.

The non-circular internal cross-sectional area can, for example, be designed as a polygon with five or more corners, for example a truncated square, a regular polygon, parallelogram, extended hexagon or the like. The inner cross-sectional surface can also be designed as a round shape. Particularly suitable are internal cross-sectional areas which are designed as rounded rectangles, stadiums, oval, ellipses, epicycloids, multi-circles or superellipses n>1.

For reactors having a non-circular cross-sectional area of the upper oxidation section, it may also be provided that the maximum distance from any point within the bulk to an outlet of at least one of the tuyeres is less than a predetermined minimum distance. The minimum distance is

- less than 1.3 m at gas temperatures below 100° C. and at gas velocities below 100 m/s
- less than 1.9 m at gas temperatures below 100° C. and at gas velocities between 100 m/s and 343 m/s (sound velocity) and
- less than 3.2 m at gas temperatures above 100° C. and/or at gas velocities >343 m/s, wherein the temperature and the gas velocities (gas flow divided by $PI/4\times ID^2$) are provided at the outlet of the tuyeres.

For example, a stadium-shaped embodiment (e.g. consisting of two semicircular surfaces with a respective diameter=M and a centrally arranged square surface with a side length=M) of the internal cross-sectional area of the reactor may achieve a capacity increase of approximately 2.1 times. Furthermore, it is conceivable that with a smaller stadium (e.g. consisting of two semicircular surfaces with a respective diameter=M and a centrally arranged square with a side length=Y, where Y≤M), the capacity of the reactor may be also increased. Furthermore, it is conceivable that with a further extension of the stadium (e.g. consisting of two semicircular surfaces with a respective diameter=M and a centrally arranged square with a side length=Y, where Y M), the capacity of the reactor may be increased almost arbitrarily to the extent that the construction site permits.

Furthermore, it is conceivable that the internal cross-sectional area is also curved or cross-shaped, in the event that the reactor has to be adapted to a non-rectangular construction site.

For all the afore mentioned embodiments of the internal cross-sectional area of the upper oxidation section and/or the pre-treatment section, the intermediate section and the upper reduction section, it may also be provided that thermal stresses occurring in the refractory lining can be compensated for temperatures up to 1500° C. by high-temperature expansion joints and for temperatures above 1500° C. by tongue-and-groove arrangements with or without circumferential water-cooled consoles.

Since no corners with an angle of 90° are provided for all the above-mentioned embodiments of the internal cross-sectional area of the upper oxidation section and/or the pre-treatment section, the intermediate section and the upper reduction section, the formation of a gas pocket in such corners can be prevented, thereby essentially avoiding that incompletely reacted gas components may reach the gas outlet via a short circuit.

Another embodiment of the invention is that only a single gas outlet is arranged in the gas outlet section of the reactor.

This embodiment may allow a simpler arrangement of the gas cleaning stages and/or lower equipment costs, as for example only one steam generator is connected to the single gas outlet, instead of several.

Further, it may be advantageous that the gas outlets or the only one gas outlet is arranged in the gas outlet section at an angle either upwards 30° to 90°, usually approx. 60°. This may ensure that liquid slag droplets or dust particles flow back into the reactor, instead of accumulating and possibly plugging the gas outlets. It further may be achieved that more dust may be retained inside the reactor due to gravity separation.

Alternatively, the gas outlet can also be angled downwards, between −60° and 0°. However, due to the downward angle dust and slag may end up in the downstream equipment. Nevertheless, this embodiment may be beneficial if the geometry is not constructible due to restriction from the construction site or special downstream equipment.

A further embodiment of the reactor according to the invention provides that the central vertical longitudinal axis of the co-current section is horizontally offset from the central vertical longitudinal axis of the gas outlet section and the gas countercurrent section. This type of reactor design is here defined as asymmetrical reactor. The central vertical longitudinal axes are essentially arranged in the center of each section. Due to the above embodiment, the co-current section is not concentrically arranged with respect to the gas outlet section and the gas countercurrent section. However, the gas outlet section and the gas countercurrent section are arranged concentrically to each other.

This embodiment ensures that the surface or discharge area of the bulk (cone-shaped bulk that protrudes from the conical lower reduction section into the gas outlet section) is increased, since the designed configuration of the bulk corresponds to an oblique truncated cone at the same height due to this arrangement.

Due to the increased surface area or discharge area of the bulk, it may be advantageously achieved that the gas outlet velocity (through the at least one gas outlet) is reduced proportionally to the increased discharge area of the bulk, whereby the dust entrainment from the bulk is reduced.

A further embodiment provides advantageously that only a single gas outlet is arranged in the gas outlet section of the reactor, that the central vertical longitudinal axis of the co-current section is horizontally offset with respect to the central vertical longitudinal axis of the gas outlet section and the gas countercurrent section, and that the single gas outlet is arranged closer to the central vertical longitudinal axis of the gas outlet section and the gas countercurrent section than to the central vertical longitudinal axis of the co-current section.

This embodiment also may provide that the surface area or discharge area of the bulk (cone-shaped bulk protruding from the conical lower reduction section into the gas outlet section) is increased, since the configuration of the bulk corresponds to an oblique truncated cone at the same height.

Since it is further provided that the only gas outlet is arranged closer to the central vertical longitudinal axis of the gas outlet section and the gas countercurrent section than to the central vertical longitudinal axis of the co-current section, it further results that the oblique truncated cone of the bulk is inclined away from the single gas outlet, thus the enlarged surface or discharge area of the bulk is arranged from opposite the gas outlet to below the gas outlet. Thus the gas can escape directly with an increased volume flow from the increased bulk surface or the inside of the bulk to the gas outlet.

The advantage of this reactor embodiment is that the surface area or discharge area of the bulk is increased, which reduces the discharge velocity and the costs may be reduced by using fewer and/or smaller downstream devices. In addition, a local entrainment of large quantities of dust can be avoided. Since the discharge area opposite the gas outlet is very small, which means that the gas flows out with a smaller volume flow due to the greater distance to the gas outlet and the resulting greater flow resistance. The speed profile is thus uniform across the entire discharge area.

It may be further advantageous that the previously described asymmetrical reactor has only a single gas outlet, the single gas outlet being arranged on the opposite side of the co-current section's longitudinal axis. This may maximize the dust retention and minimize required downstream treatment equipment.

A further embodiment of the reactor according to the invention provides that a heat exchanger and/or a steam generator is coupled downstream to the gas outlet section and gas suction means (e.g. at least one explosion-protected high-temperature blower) are coupled downstream to the heat exchanger or steam generator. This is particularly advantageous if the reactor is operated under negative pressure. The extraction by means of gas extraction medium is advantageously carried out in such a way that on the one hand hardly any or no gas escapes upwards from the reactor and on the other hand only minimal quantities of additional ambient air are sucked in by the reactor.

Furthermore, it can be advantageously provided that the reactor can also be run or operated at overpressure. For this purpose, it is intended that high-temperature gate valves are arranged in the surrounding shell of the upper oxidation section and/or the conical lower oxidation section, the high-temperature gate valves being designed to allow the tuyeres to be replaced during full operation of the reactor.

The high-temperature gate valves are advantageous, since gas can escape from the reactor when the tuyeres are exchanged during overpressure operation. It is therefore advantageous that the tuyeres are first pulled behind a high-temperature packing gland, whereby at this moment the tuyeres are still in an outer tube and are sealed in this tube by the gland. In the event that the tuyere is to be pulled or replaced, the high temperature gate valve is closed and the tuyere can be pulled completely. The installation of the new or repaired tuyeres can then be carried out by insertion, whereby the gate valve is opened and the tuyere is pushed partially into the packing gland. Hence, the valve can be safely opened and the tuyere can be inserted fully and fixed/secured. Advantageously, the high-temperature gate valves are either ceramic, heat-resistant, cooled or a combination of the above features.

Though maintenance at overpressure is more difficult, the overpressure increases the density of the gas, thus reducing the volume flow from the reactor and further reduces the size and cost of the downstream equipment.

It may be provided for all the above-mentioned embodiments of the reactor, which may be used for material and/or energetic recycling of wastes and other feed materials, that the reactor is designed in such a way that temperatures above 1800° C. can be reached in the oxidation sections in the peripheral area (boundary between bulk material and refractory) and between 2000° C. and 4000° C. in the interior (center) of the bulk. These high temperatures may however cause the refractory lining (e.g. brick lining) to expand axially, tangentially and radially up to 20 mm per lining meter, creating stresses in the refractory lining which in turn affect the outer steel shell of the reactor in a radial direction. In order that the stability of the reactor is not impaired by these high temperatures and the resulting stresses in the lining, it may be provided, in accordance with the invention, that the refractory lining of the reactor consists of at least two lining sections, axially arranged one above the other. Each lining section is arranged between means of thermal expansion compensation (e.g. expansion joints or a tongue-groove combination). Here it can be conceived that the refractory lining of the reactor is segregated in sections of 2 to 4 meters in height. For reactors which have a gas outlet temperature of 1500° C. to 1600° C., it may be provided that the reactor lining has a further lining section every 3 to 4 height meters. For reactors which have a gas outlet temperature of 1600° C. and 1750° C., it may be provided that the reactor lining has an additional lining section every 2 to 3 height meters. Since particularly high temperatures (between 1800° C. and 4000° C.) are generated for high gas outlet temperatures, in particular in the upper oxidation section and the conical lower oxidation section, it may be provided that the lining sections arranged one above the other are arranged in such a way that exactly one lining section is arranged in each of the upper oxidation section and the conical lower oxidation section. Furthermore, it may be provided that a further lining section is arranged below and above the oxidation sections. This can ensure that the hot oxidation sections each are composed of only one lining section, each can expand in the direction of the respective above lining section, which is colder. In order that no hot gases or high temperatures continue to escape outside via the gap between the at least two lining sections, it may also be provided that a tongue-and-groove connection is formed between the lining sections arranged one above the other, wherein one of the lining sections has the groove on the side facing the reactor interior and the other lining section has the tongue on the side facing the reactor interior. The tongue-and-groove connection can be designed in such a way that even when the reactor is at a standstill, thus colder and the gap between lining section is maximum, the tongue in the groove is arranged in a positive-locking manner, whereby the vertical outer wall of the tongue is connected to the vertical wall of the groove, but a vertical gap opening remains between the groove and the tongue. This is an advantage in ensuring that despite the gap opening no heat and gas can reach the outer insulating layer(s) and the steel shell during start-up or high heating of the reactor, and that less or no gas can escape to the outside. Furthermore, it may be provided that the gap opening between the groove and the tongue is a temperature-dependent gap opening. The temperature-dependent gap opening between the groove and the tongue can be for example 50 mm. As described above, the refractory lining can expand at high temperatures, where the tongue can expand into the groove due to the tongue-and-groove connection. Furthermore, it may be provided that between the at least two lining sections arranged one above the other there is arranged a circumferential water-cooled console for holding the refractory lining and stabilizing the lining during heating up and cooling down of the reactor. This circumferential water-cooled console can be produced by bending hollow section tubes with square, circular or rectangular cross-sectional areas without welding seams. It can be advantageously provided here that the water-cooled console has a high heat flow, which is achieved by flow velocities of the cooling water from 0.8 m/s to 25 m/s. The high flow velocities of the cooling water are advantageous for maintaining the thermal and mechanical stability of the circumferential water-cooled console when arranged in areas with high temperatures (>1500° C.). The arrangement described above of at least two superimposed tongue-and-groove lining sections and a circumferential water-cooled console may be arranged in the co-current section and/or the gas outlet section and/or the countercurrent section. Each section can also have several arrangements of two lining sections arranged one above the other with tongue-and-groove connection and circumferential water-cooled console. It may also be provided that the upper lining section has the groove and the lower lining section has the tongue. This can cause the refractory lining to expand upwards when exposed to hot temperatures. Furthermore, it is conceivable that each of the at least two lining sections comprises at least one inner lining and an outer lining encasing the inner lining. Here it can be provided that the interior lining is a brick lining made of fired bricks or a monolithic (e.g. castable) refractory lining.

The above-mentioned tasks of the invention are also solved by one or more methods described herein for gasifying, cracking and/or melting of feed materials, which is advantageously suited, among other things, for the material and/or energetic recycling of wastes and other feed materials.

The method steps in accordance with the invention initially include providing feed materials into the co-current section, whereby the feed materials are introduced via the feed section with a sluice. In the subsequent buffer section, the feed materials are preheated and pre-dried and then reach the pre-treatment section, wherein the cross-section of the pre-treatment section is enlarged with respect to the buffer section, where the feed materials form a discharge bulk in a cone shape. The surface of the bulk is heated in the pre-treatment section to at least 800° at its surface by supplying oxygen and/or air and/or combustion gases or by supplying preheated oxygen and/or air or combustion gas, which are supplied via gas supply means (e.g. burners and/or nozzles) which open in the pre-treatment section in the region of the cross-sectional enlargement of the pre-treatment section, in order to trigger at least partial pyrolysis on the surface of the feed materials.

In the subsequent intermediate section, the feed materials are fully pyrolyzed and fully dried.

By supplying untreated or preheated oxygen and/or air through the tuyeres arranged in at least two levels, a hot upper oxidation section is created, which is located below the intermediate section. The pyrolysis products and parts of the feed materials burn, crack and/or melt in this hot upper oxidation section, whereupon further coking of the not yet converted feed materials takes place.

In the subsequent upper reduction section, thermal energy is then converted into chemical energy. The gas flows in the co-current section from the feed section to the gas outlet in co-current.

A hot section is also created in the conical lower oxidation section by supplying untreated or preheated oxygen and/or air through the at least one tuyere of the conical lower oxidation section. Molten metal and molten slag are also collected in this lower-arranged hot lower oxidation section. These molten metal and/or molten slag are tapped off via at least one tapping (e.g. in molds) or run out continuously (e.g. to a slag granulation) as required.

In the conical lower oxidation section and in the conical lower reduction section, gases are also generated which flow upwards (in countercurrent) in the direction of the gas outlet. The gases from the co-current section (from top to bottom) and the gases from the countercurrent section (from bottom to top) are discharged from the gas outlet section through the at least one gas outlet.

The method steps essential for the invention can be advantageously further developed by exhausting the gases produced in the co-current section and the gases produced in the countercurrent section by suction. For this purpose, gas suction means are used. The suction creates a negative pressure in the reactor. The use of negative pressure in the reactor allows maintenance of the reactor during operation, as air can be sucked in when the reactor is opened, but no gas can escape.

Alternatively, an overpressure may be generated in the reactor, whereby the gases produced in the reactor are discharged by overpressure.

At overpressure, as low as 200 mbar overpressure, the reactor forces the hot gas into the subsequent process steps. This embodiment eliminates the need for an explosion-protected high-temperature suction blower. Furthermore, higher pressures up to 10 bar overpressure, which are possible in the reactor according to the invention, allow the volume of the escaping gas to be reduced, whereby smaller apparatuses can be used for gas purification. The operation with positive pressure is advantageous in that the gas is forced out of the reactor. For this purpose, the pressure in the reactor is created by the resulting gas, the thermal expansion of the gas and the supply of the gaseous media with excess pressure.

The at least one sluice for the feeding of the feed materials can be opened or closed without any problems. This can be solved constructively for example, with hydraulically operated hatches (doors). The hatches are arranged in such a way that in the event of desired or accidental overpressure in the reactor, the hatches are additionally pressed closed and no gas can escape unintentionally. It may also be advantageous that the sluices have additional pressure equalization lines to the atmosphere and/or to a safe area inside the reactor. Accordingly, the hatches can also be opened at the any desired overpressure in the reactor because the hatches drive does not have to work against a pressure difference.

It may also be provided that inert gases like nitrogen or $CO_2$ are injected to start up the reactor.

According to another aspect of the invention, the reactor for gasifying and/or melting of feed materials, as described above, can be used for the recovery of energy.

Hence, feed materials such as waste materials may be fed to the reactor and its internal energy is gained in form of gas, which contains chemical and thermal energy, which may be used to generate electricity (waste-to-energy).

Further advantages, details and developments result from the following description of the invention, with reference to the attached drawings.

FIG. 1*a* shows a simplified cross-sectional view of an embodiment of an invented reactor.

FIG. 1*b* shows another simplified cross-sectional view of an embodiment of an invented reactor.

Like-numbered elements in these figures are either identical or fulfill the same function. Elements previously discussed are not necessarily discussed in later figures if the function is equivalent.

In the following FIG. 1*a* describes an embodiment of a substantially cylindrical reactor 100. In connection with the explanation of the details of the reactor, the method steps that take place during the treatment of wastes with organic components as feed materials in this reactor are also specified.

By using other feed materials, modifications of the reactor and/or method may be useful. In general, different feed materials can also be combined, for example by adding feed materials with a higher energy value (e.g. non-recyclable plastic, contaminated waste wood, car tires, or the like) during the gasifying/cracking/melting of non-organic feed materials.

Figure 1A:
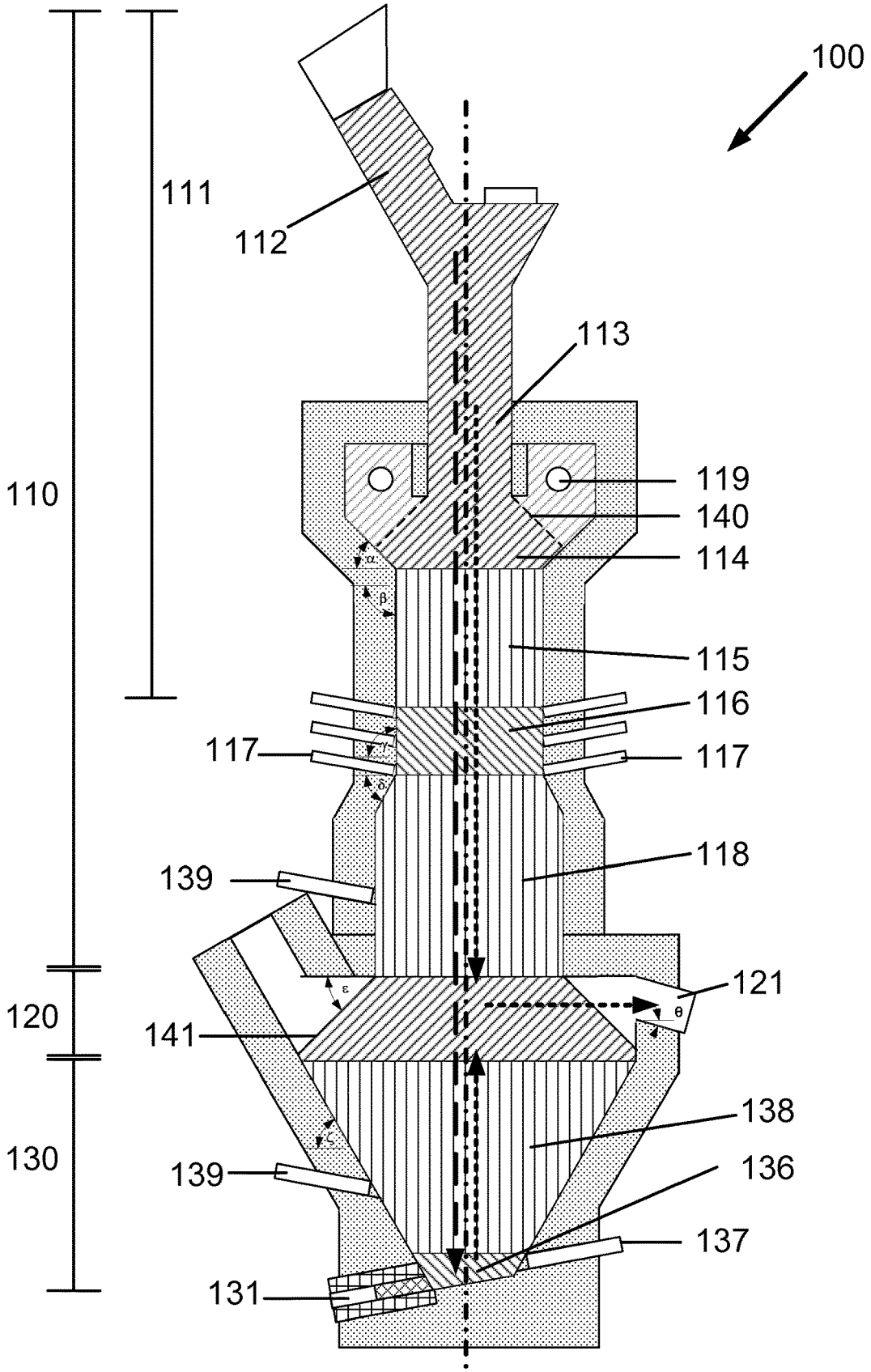

The reactor 100 shown in FIG. 1*a* has three major sections, which are a co-current section 110, a gas outlet section 120 and a countercurrent section 130. The co-current section 110, the gas outlet section 120 and the countercurrent section 130 are surrounded by a, e.g. steel shell, which of obvious necessity has recesses for means for feeding feed materials and gases as well as discharging gases and materials. The co-current section 110, the gas outlet section 120 and the countercurrent section 130 are arranged substantially concentrically to each other (represented by the vertical dash-dot line passing substantially through the center of the reactor). In the co-current section a plenum section 111, an upper oxidation section 116 and an upper reduction section 118 are arranged. The plenum section 111 comprises a feed section with a sluice 112, whereby feed materials such as waste, water, car tires, additives or other feed materials are fed into the reactor from above via the feed section. The material flow of the solids is shown as a dashed arrow from top to bottom. A buffer section 113 is arranged below the feed section with a sluice 112. Below the buffer section 113 a pre-treatment section 114 for buffering and pre-drying the feed material volume is arranged below the buffer section, thereby creating a cross-sectional enlargement in the upper area and a narrowing cross-section in the bottom area so that a collapsing cone (140) of the feed material can form from feed materials (indicated by the oblique dashed lines; between 114 and 119). Hereby, the bottom area corresponds to an inverted truncated cone with an angle $\alpha$, wherein $\alpha$ is advantageously between 120° and 150°, preferably 135°. As further shown in FIG. 1*a*, two gas supply means 119 open in the pre-treatment section 114 in the region of the cross-sectional enlargement. Through the gas supply means 119 hot gases can be fed to the collapsing cone. Pyrolysis takes place on the surface and inside the collapsing cone 140. The pre-treatment section 114 can also be made inert by burning off all oxygen stoichiometrically (as lambda may be approximately 1), e.g. controlled by a low-cost paramagnetic or chemical oxygen-analyzer. Hence, the expensive nitrogen-blanketing, as needed for other reactors may be avoided. Below the pre-treatment section 114 there is an intermediate section 115 which is equipped for final drying and complete pyrolysis. As shown in FIG. 1*a* the intermediate section 115 has a substantially cylindrical inner diameter. An essentially cylindrical oxidation section 116 adjoins the intermediate section 115, wherein in the upper oxidation section 116 the tuyeres 117 are arranged circumferentially in a plurality of levels (here three levels as shown). Untreated and/or preheated oxygen and/or air is added via the tuyeres 117, which increases the temperature to such an extent that all substances are converted into inorganic gas, liquid metal, coke, carbon and/or mineral slag. In the upper reduction section 118, which adjoins the upper oxidation section 116 and which is arranged substantially above a subsequent gas outlet section 120, the endothermic conversion of thermal energy into chemical energy takes place. At the same time, the gas flowing co-current with the solids (represented by a dotted arrow running from top to bottom), is generated starting from the plenum section via to the upper oxidation section and the upper reduction section 118 from top to bottom, and then introduced into the gas outlet section 120.

As shown, the gas outlet section 120 is connected to the upper reduction section 118, thereby creating a cross-sectional enlargement. As the cross-sectional area of the gas outlet section 120 is larger than the cross-sectional area of the upper reduction section 118, a cone-shaped bulk 141 can form. The gas produced is—approximately in cross-flow to the cone-shaped bulk 141—discharged in the gas outlet section 120 through at least one gas outlet 121 (shown by a dotted arrow running from left to right). It may be provided, for example, that four or more gas outlets 121 are distributed around the circumference (not shown), so that the gas produced in the co-current section and in the countercurrent section can be diverted radially in the cross-flow. The gas outlet 121 can be designed in such a way that the gas can flow downwards. The angle θ of the gas outlet is downwards between −60° and 0° (horizontal), Indicated in FIG. 1 is an angle with −30°. The gas outlet, however, can also be designed in such a way that the gas is discharged upwards (as depicted in FIG. 2), with an angle θ of the gas outlet being in particular 60°. Thus, depending on the application and constructability restrictions, any angle between −60° (sloped down), 0° (horizontal) and 90° (straight up vertically) can be designed Below the gas outlet section 120 the countercurrent section 130 is arranged, the countercurrent section 130 comprising the conical lower reduction section 138 and the conical lower oxidation section 136. As indicated in FIG. 1 the countercurrent section 130 is conical and tapered (narrows) towards the bottom of the reactor with an angle ζ, the angle ζ being between 50° and 70°, here approximately 60°. In the conical lower reduction section 138 the conversion of thermal energy into chemical energy also takes place.

Below the conical lower reduction section 138 there is, as shown, a conical lower oxidation section 136 in which at least one tuyere 137 and at least one tapping 131 are arranged. Through the at least one tuyere 137 untreated or preheated oxygen air and/or oxygen is introduced in order to oxidize the remaining carbonized material and to prevent the molten metal and molten slag from solidifying. The collection and discharge of molten metal and molten slag takes place in at least one tapping 131.

The gas generated in the conical lower oxidation section 136 and in the conical lower reduction section 138 also flows in countercurrent with the solid's flow through the bulk (represented by a dotted arrow running from bottom to top) to the gas outlet section 120, where it is discharged via the at least one gas outlet 121.

The reactor of FIG. 1*a* may have sectional internal volumes as disclosed for example 2 of table 1.

Of course, the reactor can also have other dimensions and thus other internal volumes, however, in this case the ratios are either essentially the same or within defined ranges. For this the volume ratio of the upper oxidation section volume to the plenum section volume can be a ratio of 1:N volume units, wherein N is a number greater than or equal to (≥)4 and less than or equal to (≤)20.

It may be advantageous that the gases produced in the co-current section 110 and in the countercurrent section 130 are discharged by suction. Furthermore, it can be advantageously provided that an overpressure is generated in the co-current section 110, whereby the gases produced in the co-current section 110 are discharged by overpressure.

Although the embodiment form specifically described above is particularly suitable for the treatment (gasifying, cracking and/or melting) of wastes, it will be obvious to the skilled person in the art that modifications of the reactor are necessary or expedient when other feed materials are used. In general, however, the reactor described above can also be used to treat hazardous wastes or feed materials with higher metal contents, whereby the gasification/cracking principle and the melting principle will predominate in some cases. Different feed materials can also be combined. For example, it is possible to add specific feed materials with a higher energy value (e.g. non-recyclable plastics, contaminated waste wood, tires, but also coal or the like) for melting non-organic feed materials.

Figure 1B:
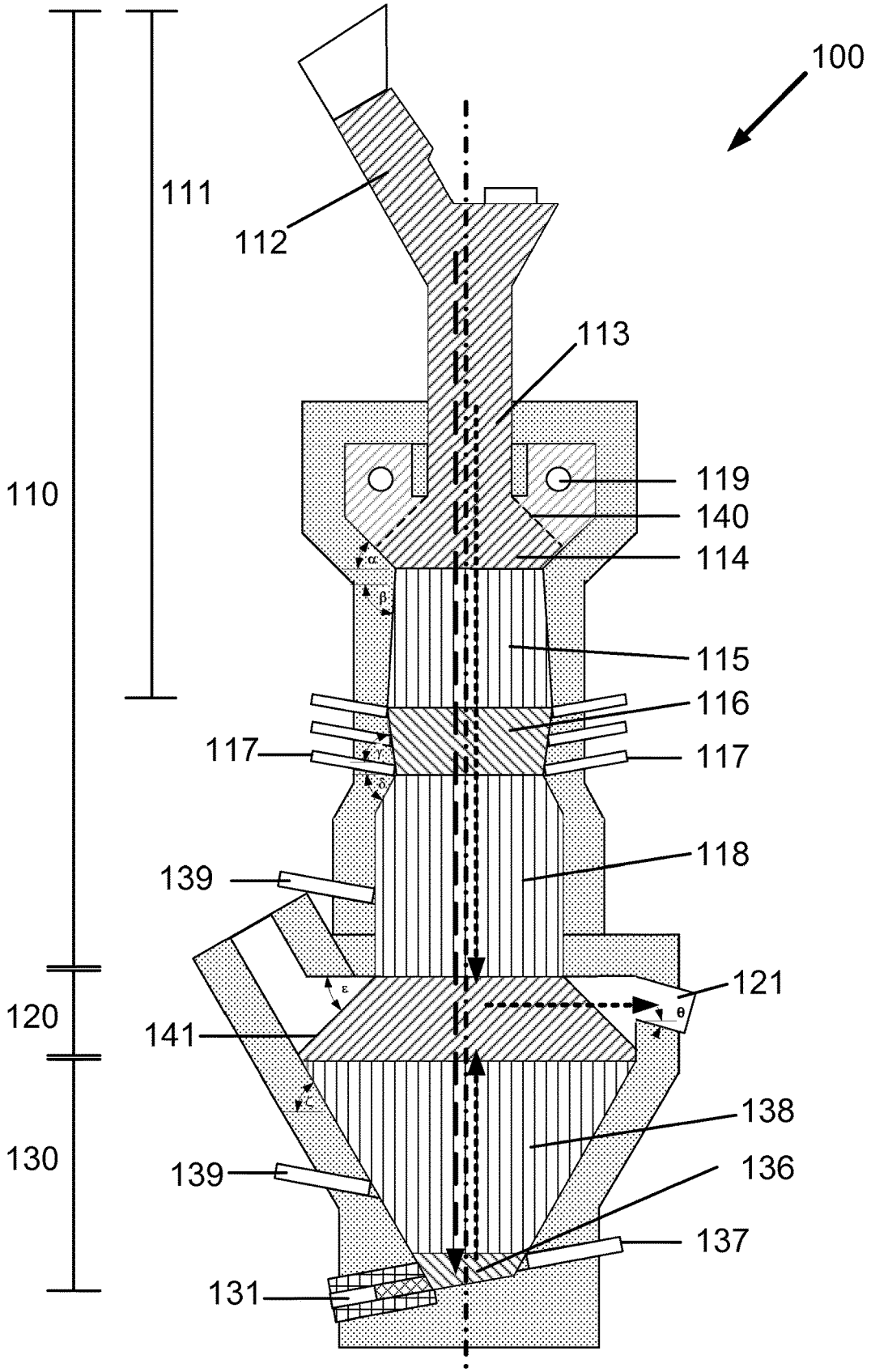
Figure 2:
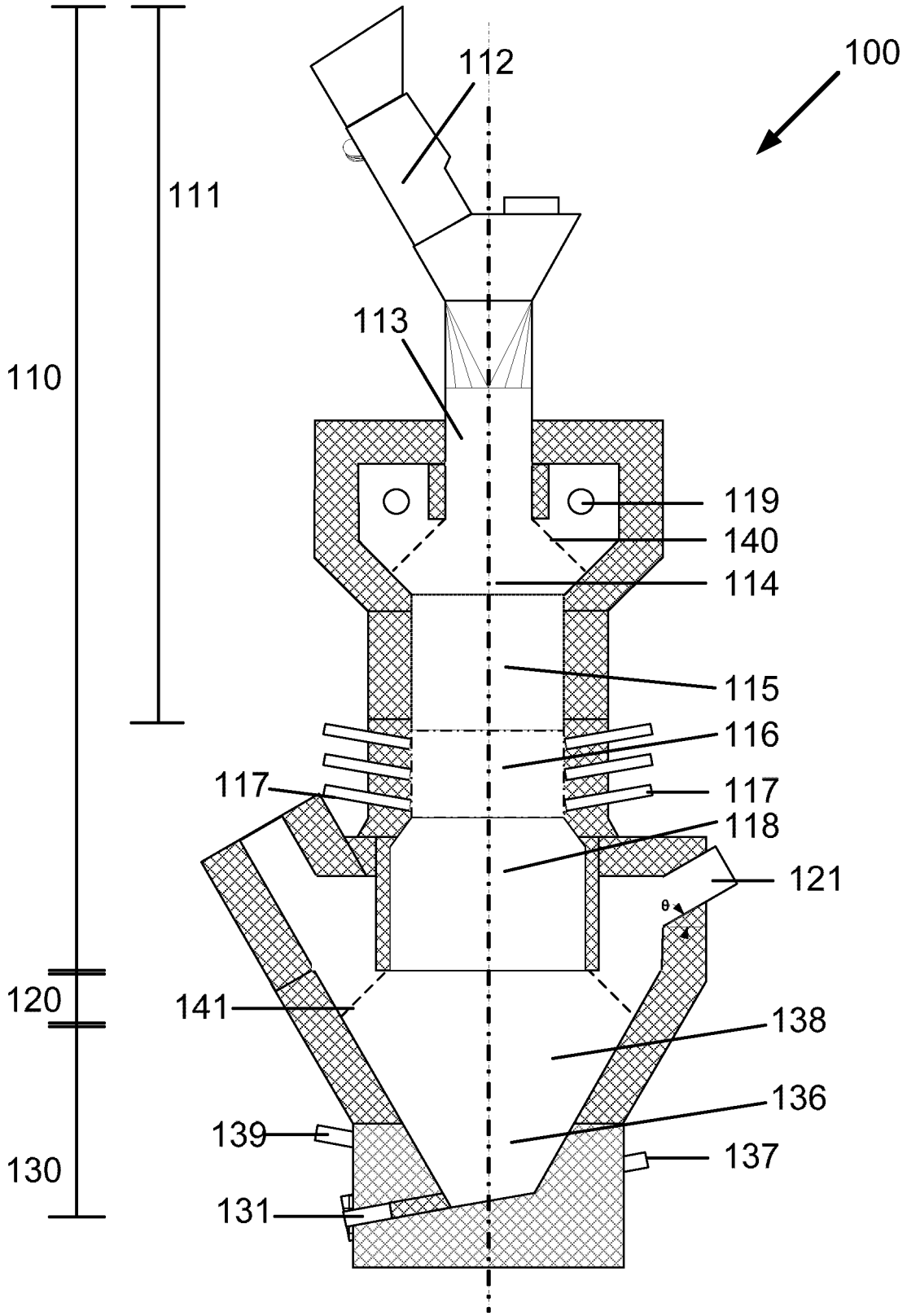
FIG. 2 shows a simplified cross-sectional view of a further embodiment of an invented reactor with the upper reduction section partially inserted into the gas outlet section.

The reactor 100 shown in FIG. 1*b* corresponds substantially to the reactor 100 shown in FIG. 1*b*, however in this embodiment the inner cross-sectional area of the intermediate section 115 widens (see angle β, wherein β is between 80° and 90°, here approximately 87°) in the direction of the reactor floor and the inner cross-sectional area of the upper oxidation section 116 tapers/narrows (see angle γ, wherein γ is between 80° and 90°, here approximately 85°) in the direction of the reactor floor. Further, as indicated by the angle δ, the cross-sectional area of upper reduction section 118 expands (see angle δ, wherein δ is between 50° and 70°, here approximately 60°) directly below the oxidation section 116.

The reactor 100 shown in FIG. 2 corresponds substantially to the reactor 100 shown in FIG. 1*a*, but in this embodiment the co-current section 110 with a portion of the upper reduction section 118 is inserted into the gas outlet section 120. As shown, the refractory lining (e.g. brick lining) of the upper reduction section 118 protrudes into the gas outlet section 120. Since the gas outlet section 120 has a larger cross-sectional area than the upper reduction section 118 and the at least one gas outlet 121 is located in the edge region of the gas outlet section 120, the gas produced in the co-current section 110 must bypass the refractory lining (e.g. brick lining) protruding into the gas outlet section 120 in order to reach the gas outlet 121, whereby less dust enters the following apparatus.

The reactor of FIG. 2 may have sectional internal volumes as disclosed for example 1 of table 1.

Of course, the reactor can also have other dimensions and thus other internal volumes, however, in this case the ratios are either essentially the same or within defined ranges. For this the volume ratio of the upper oxidation section volume to the plenum section volume shall be a ratio of 1:N volume units, wherein N is a number greater than or equal to (≥)4 and less than or equal to (≤)20.

Figure 3:
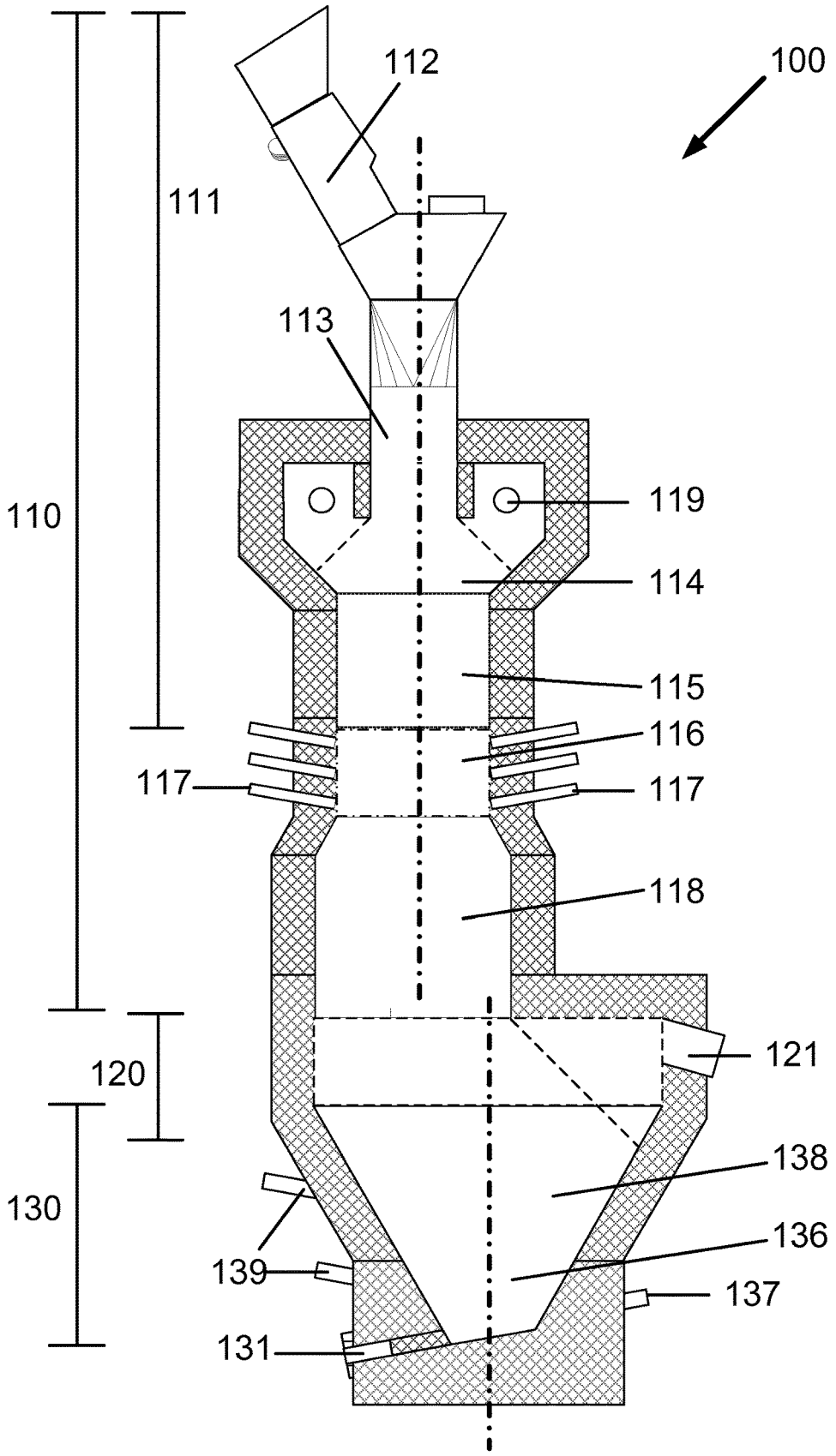
FIG. 3 shows a simplified cross-sectional view of another embodiment of an invented reactor, where the central vertical longitudinal axis of the co-current section is horizontally offset from the central vertical longitudinal axis of the gas outlet section.

FIG. 3 shows another embodiment of the reactor 100. The reactor according to FIG. 3 corresponds substantially to the reactor 100 according to FIG. 1*a*, but in the gas outlet section 120 of the reactor only a single gas outlet 121 is arranged, the central vertical longitudinal axis of the co-current section 110 is arranged horizontally offset with respect to the central vertical longitudinal axis of the gas outlet section 120 and the gas countercurrent section 130 and the single gas outlet 121 is arranged closer to the central vertical longitudinal axis of the gas outlet section 120 and the gas countercurrent section 130 than to the central vertical longitudinal axis of the co-current section 110.

The central vertical longitudinal axes are shown as dash-dot lines in FIG. 3. As shown, the central vertical longitudinal axes are essentially arranged at the center of each section. As shown, the co-current section 110 is not arranged concentrically with respect to the gas outlet section 120. However, the gas outlet section 120 is arranged concentrically to the countercurrent section 130.

The advantage of this embodiment of the reactor 100 is that the surface area or the discharge area of the bulk is increased, which increases the discharge rate and reduces costs by reducing the number and/or size of downstream devices.

The reactor of FIG. 3 may have the sectional internal volumes as disclosed for example 3 of table 1.

Of course, the reactor can also have other dimensions and thus other internal volumes, however, in this case the ratios are either essentially the same or within defined ranges. For this the volume ratio of the upper oxidation section volume to the plenum section volume shall be a ratio of 1:N volume units, wherein N is a number greater than or equal to (≥)4 and less than or equal to (≤)20.

Figure 4:
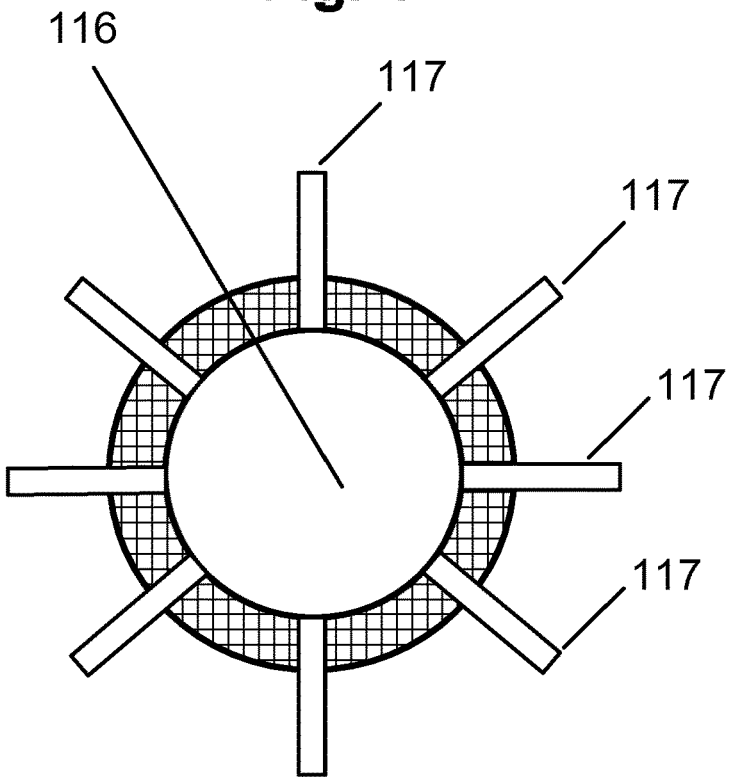
FIG. 4 shows the internal cross-sectional area of the upper oxidation section of a reactor, wherein the internal cross-sectional area is substantially formed as a circular area.

FIG. 4 shows a configuration of the internal cross-sectional area of the upper oxidation section 116 of a reactor 100, wherein the internal cross-sectional area is essentially formed as a circular area. The reactor 100 according to FIG. 1*a*, according to FIG. 1*b*, according to FIG. 2 or according to FIG. 3 can be a reactor with a circular internal cross-sectional area, as shown here. As shown, several tuyeres 117 are arranged (here only one level is visible) through which untreated or preheated oxygen and/or air are blown onto or injected into the bulk. The tuyeres 117 are distributed around the circumference of the circular area, so that preferably every point of the bulk can be supplied with the blown in or injected in untreated or preheated oxygen and/or air. Here, it is envisioned that the maximum distance from any point within the bulk formed from feed materials to an outlet of at least one of the tuyeres 117 is less than a predetermined minimum distance. The minimum distance is less than 1.3 m at gas temperatures below 100° C. and at gas velocities below 100 m/s, less than 1.9 m at gas temperatures below 100° C. and at gas velocities between 100 m/s and 343 m/s (sound velocity) and less than 3.2 m at gas temperatures above 100° C. and/or at gas velocities >343 m/s. Hereby, the temperature and the gas velocities (gas flow divided by $PI/4\times ID^2$) are given at the outlet of each of the tuyeres.

Figure 5:
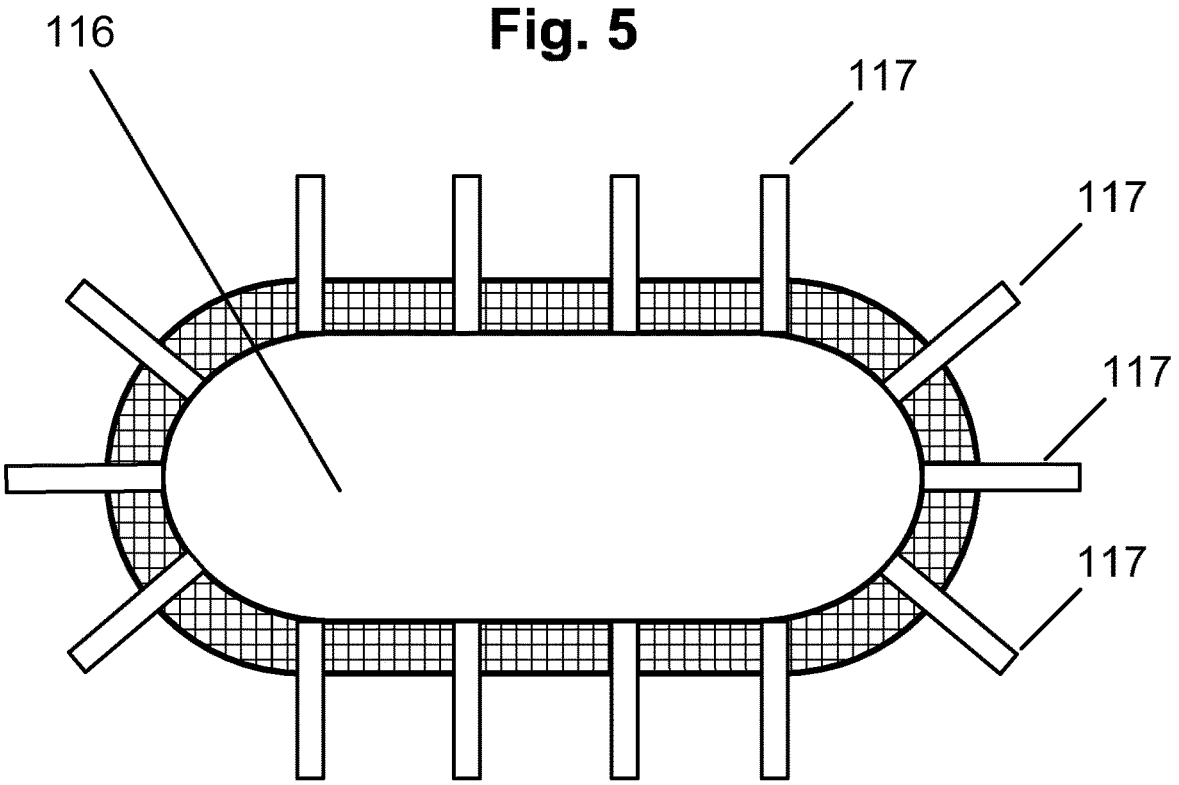
FIG. 5 shows the internal cross-sectional area of the upper oxidation section of a reactor, wherein the internal cross-sectional area is substantially designed as a stadium.

FIG. 5 shows a configuration of the internal cross-sectional area of the upper oxidation section 116 of a reactor, wherein the internal cross-sectional area is essentially designed as a stadium. The reactor 100 according to FIG. 1*a*, FIG. 1*b*, FIG. 2 or FIG. 3 can be a reactor with a stadium-shaped internal cross-sectional area. As shown, several tuyeres are arranged (here only one level is shown) through which untreated or preheated oxygen and/or air are blown in or injected in the bulk. The tuyeres 117 are distributed evenly around the circumference of the stadium area, so that preferably every point of the bulk can be supplied with the injected in untreated or preheated oxygen and/or air. Here, it is envisioned that the maximum distance from any point within the bulk to an outlet of at least one of the tuyeres 117 is less than a predetermined minimum distance. The minimum distance is less than 1.3 m at gas temperatures below 100° C. and at gas velocities below 100 m/s, less than 1.9 m at gas temperatures below 100° C. and at gas velocities between 100 m/s and 343 m/s and less than 3.2 m at gas temperatures above 100° C. and/or at gas velocities >343 m/s. Hereby, the temperature and the gas velocities (gas flow divided by $PI/4\times ID^2$) are given at the outlet of the tuyeres. This embodiment, for which the internal cross-sections of the co-current section may have, as the upper oxidation section 116, a stadium-shaped internal cross-sectional area, results in an increase in the diameter of the (horizontal) cross-section of the reactor and thus in an increase in capacity. Due to the non-circular cross-section, the bulk, in particular also the center of the bulk, is easily accessible for the untreated or preheated oxygen and/or air introduced via the tuyeres 117. A 2.1-fold increase in capacity is achieved through a stadium-shaped embodiment of the internal cross-sectional area of the whole reactor.

LIST OF REFERENCE NUMERALS

100 Reactor
110 Co-current section
111 Plenum section
112 Sluice
113 Buffer section
114 Pre-treatment section
115 Intermediate section
116 Upper oxidation section
117 Tuyeres
118 Upper reduction section
119 Gas supply materials
120 Gas outlet section
121 Gas outlet
130 Countercurrent section
131 Tapping
136 Conical lower oxidation section
137 Tuyere
138 Conical lower reduction section
140 Collapsing cone area
141 Cone-shaped bulk

The invention claimed is:

1. A reactor for gasifying and/or melting of feed materials, the reactor comprising:

a co-current section including:

a plenum section including:

a feed section with a sluice through which the feed materials are introduced into the reactor from above, a buffer section located below the feed section, a pre-treatment section that is located below the bottom of the buffer section and defines a collapsing cone which has a cross-sectional enlargement in an upper area and a narrowing cross-section in a bottom area so that material flow in a packed bed is achieved, at least one gas supply means which open in the pretreatment section in the region of the cross-sectional enlargement of the pretreatment section and through which hot gases can be fed to the collapsing cone, and an intermediate section that is located below the bottom of the pre-treatment section, an upper oxidation section located below the intermediate section, the upper oxidation section comprising tuyeres arranged in at least two levels, wherein through the tuyeres untreated or preheated oxygen and/or air is suppliable, and an upper reduction section located below the upper oxidation section, a gas outlet section including at least one gas outlet, wherein the cross-sectional area of the gas outlet section is larger than the cross-sectional area of the upper reduction section so that a cone-shaped bulk is configured to form, and a countercurrent section including:

a conical lower reduction section located below the gas outlet section, and a conical lower oxidation section for accumulating on the bottom molten metal and molten slag, the conical lower oxidation section being located below the conical lower reduction section and comprising at least one tuyere through which untreated or preheated oxygen and/or air is suppliable to the molten metal and molten slag, as to prevent solidification, and at least one tapping for draining the molten metal and molten slag.

2. The reactor for gasifying and/or melting feed materials of claim 1, wherein the upper reduction section is fully arranged above the gas outlet section, the gas outlet section is located below the upper reduction section while providing a cross-sectional enlargement.

3. The reactor for gasifying and/or melting feed materials of claim 1, wherein at least a portion of the upper reduction section is arranged in the gas outlet section, the gas outlet section having a cross-sectional enlargement with respect to the upper reduction section.

4. The reactor for gasifying and/or melting of feed materials of claim 1, wherein the volume ratio of the upper oxidation section volume to the plenum section volume is a ratio of 1:N volume units, wherein $4 \leq N \leq 20$.

5. The reactor for gasifying and/or melting feed materials of claim 1, wherein the volume ratio of the upper oxidation section volume to the total volume of the upper reduction section volume and the plenum section volume is a ratio of 1:N volume units, wherein $7 \leq N \leq 20$.

6. The reactor for gasifying and/or melting feed materials according to claim 1, wherein the volume ratio of the countercurrent section volume to the total volume of the reactor is a ratio of 1:N volume units, wherein $1 \leq N \leq 8$.

7. The reactor for gasifying and/or melting feed materials of claim 1, wherein the angle ($\zeta$) of the conical lower reduction section and the angle ($\zeta$) of the conical lower oxidation section are between 50° and 70°.

8. The reactor for gasifying and/or melting feed materials of claim 1, wherein the pre-treatment section, the intermediate section, the upper oxidation section, the upper reduction section, the gas outlet section, the conical lower reduction section and the conical lower oxidation zone each comprise a refractory lining, wherein each refractory lining of each section comprises between two and six layers, each layer being made of a different material.

9. The reactor for gasifying and/or melting feed materials according to claim 8, wherein the refractory lining of the upper oxidation section comprises between three and six layers, each layer being made of a different material, the sum of the layer thicknesses having a thickness of at least 600 mm.

10. The reactor for gasifying and/or melting feed materials of claim 1, wherein the inner cross-sectional area of the intermediate section is cylindrically constant or is tapered in the direction of the reactor floor, the inner cross-sectional area of the upper oxidation section is cylindrically constant or is tapered in the direction of the reactor floor and the inner cross-sectional area of the upper reduction section is cylindrical constant or widens towards the bottom of the reactor immediately following the upper oxidation section.

11. The reactor for gasifying and/or melting feed materials according to claim 1, wherein at least one further tuyere is arranged in a further level of the conical lower reduction section or one further tuyere is arranged in a further level of the conical lower reduction section and at least one additional tuyere is arranged in the upper reduction section.

12. The reactor for the gasifying and/or melting of feed materials according to claim 1, wherein at least one further tuyere is arranged in a further level of the conical lower oxidation section.

13. The reactor for gasifying and/or melting feed materials according to claim 1, wherein:

the internal cross-sectional area of the upper oxidation section is formed such that the maximum distance from any point within a discharge bulk formed from feed materials to an outlet of at least one of the tuyeres is less than a predetermined minimum distance, the minimum distance being;

less than 1.3 m at gas temperatures below 100° C. and at gas velocities below 100 m/s, less than 1.9 m at gas temperatures below 100° C. and at gas velocities between 100 m/s and 343 m/s, and less than 3.2 m at gas temperatures above 100° C. and/or at gas velocities exceeding 343 m/s, and the temperature and the gas velocities are provided at the outlet of the tuyeres.

14. The reactor for the gasifying and/or melting of feed materials of claim 1, wherein an internal cross-sectional area of the upper oxidation section is formed as a non-circular surface, in particular as a rounded rectangle, stadium, oval, ellipse, epicycloid, multi-circle, superellipse n>1, supercircle n=4 or as a polygon with five or more corners, such as a truncated square, a regular polygon or parallelogram.

15. The reactor for gasifying and/or melting feed materials of claim 1, wherein only one gas outlet is arranged in the gas outlet section.

16. The reactor for gasifying and/or melting feed materials of claim 1, wherein the at least one gas outlet according to claim 1 is arranged in the gas outlet section at an angle ($\theta$) of −60° to +90°.

17. The reactor for gasifying and/or melting feed materials of claim 1, wherein the central vertical longitudinal axis of the co-current section is arranged horizontally offset with respect to the central vertical longitudinal axis of the gas outlet section and the gas countercurrent section.

18. The reactor for gasifying and/or melting feed materials of claim 17, wherein the only gas outlet is located closer to the central vertical longitudinal axis of the gas outlet section and the gas countercurrent section than to the central vertical longitudinal axis of the co-current section.

19. The reactor for gasifying and/or melting feed materials of claim 1, wherein a heat exchanger and/or a steam generator is coupled downstream to the gas outlet section and gas suction means are coupled downstream to the heat exchanger or steam generator.

20. The reactor for gasifying and/or melting feed materials of claim 1, wherein high-temperature gate valves are arranged in the shell of the upper oxidation section and/or the conical lower oxidation section, the high-temperature gate valves being designed to allow the tuyeres to be replaced during use of the reactor.

21. A method for gasifying and/or melting feed materials using a reactor according to claim 1, the method comprising the following steps:

providing feed materials into the co-current section, wherein the feed materials are fed via the feed section with a sluice, wherein the feed materials are preheated and pre-dried in the buffer section, wherein by the providing of the feed materials in the pre-treatment section, a discharge bulk having an internal collapsing cone is formed, wherein the cross-section of the pre-treatment section is enlarged with respect to the buffer section, heating the discharge bulk in the pre-treatment section to at least 800° C. by supplying air and/or oxygen and/or combustion gas through the at least one gas supply means, which open in the pre-treatment section in the region of the cross-sectional enlargement of the pre-treatment section, in order to initiate pyrolysis at the surface of the feed materials or in the feed materials, the feed materials being fully pyrolyzed and fully dried in the subsequent intermediate section;

providing a lower lying hot upper oxidation section by supplying untreated or preheated oxygen and/or air through the tuyeres arranged in at least two levels, and burning the pyrolysis products and feed materials, melting of metallic and mineral constituents, if any, and further coking the feed material residues in the hot upper oxidation section;

converting thermal energy into chemical energy in the upper reduction section, providing a lower lying hot lower oxidation section by supplying untreated or preheated oxygen and/or air through the at least one tuyere to the accumulated molten metal and molten slag present in the conical lower oxidation section to maintain the molten metal and molten slag in a molten state and draining the molten metal and molten slag through the at least one tapping as necessary, discharging the gases generated in the co-current section through the at least one gas outlet of the gas outlet section, and discharging the gases generated in the countercurrent section through the at least one gas outlet of the gas outlet section, the gases formed in the conical lower oxidation section of the countercurrent section flowing via the conical lower reduction section to the gas outlet section.

22. The method of claim 21, wherein the gases generated in the co-current section and the gases generated in the countercurrent section are discharged by suction.

23. The method of claim 21, wherein an overpressure is generated in the co-current section, wherein the gases generated in the co-current section are discharged by overpressure.

24. The method of claim 21, wherein nitrogen is injected to start the reactor.

25. A use of a reactor for gasifying and/or melting of feed materials according to claim 21 for the recovery of energy.

* * * * *